US009222743B1

(12) United States Patent
Shah et al.

(10) Patent No.: US 9,222,743 B1
(45) Date of Patent: Dec. 29, 2015

(54) FIREARM SAFETY DEVICE

(71) Applicant: Umm Al-Qura University, Makkah (SA)

(72) Inventors: Noman Ahmed Shah, Makkah (SA); Imran Ahmed Shah, Lahore (PK); Kamran Ahmed Shah, Leeds (GB)

(73) Assignee: Umm Al-Qura University (SA)

( * ) Notice: Subject to any disclaimer, the term of this patent is extended or adjusted under 35 U.S.C. 154(b) by 0 days.

(21) Appl. No.: 14/645,496

(22) Filed: Mar. 12, 2015

(51) Int. Cl.
*F41A 17/46* (2006.01)
*F41A 17/08* (2006.01)

(52) U.S. Cl.
CPC ..... *F41A 17/46* (2013.01); *F41A 17/08* (2013.01)

(58) Field of Classification Search
CPC ..... F41A 17/00; F41A 17/06; F41A 17/063; F41A 17/30; F41A 17/46; F41A 17/08
USPC ..... 42/70.11, 84, 70.01, 70.07, 70.06, 66
See application file for complete search history.

(56) References Cited

U.S. PATENT DOCUMENTS 3,939,679 A * 2/1976 Barker ..... E05B 47/068 341/181
H538 H * 11/1988 Betzold ..... F41A 17/08 434/22
5,168,114 A 12/1992 Enget
5,461,812 A 10/1995 Bennett
5,564,211 A 10/1996 Mossberg et al.
6,219,952 B1 * 4/2001 Mossberg ..... F41A 17/063 42/70.01
6,314,671 B1 * 11/2001 Gering ..... F41A 17/063 42/70.11
6,438,887 B1 * 8/2002 Martin ..... F41A 17/06 42/70.11
6,711,844 B2 3/2004 Rumfelt
8,127,482 B2 3/2012 O'Shaughnessy et al.
8,464,459 B1 6/2013 Summers
2002/0032976 A1 * 3/2002 Riener ..... F41A 17/063 42/70.11
2002/0178635 A1 * 12/2002 Martin ..... F41A 17/06 42/70.11
2014/0202058 A1 * 7/2014 Zhou ..... F41A 17/063 42/70.11
2014/0215881 A1 * 8/2014 Milde, Jr. ..... F41A 35/00 42/70.06
2015/0040453 A1 * 2/2015 Ballard ..... F41A 17/063 42/70.11
2015/0184963 A1 * 7/2015 Milde, Jr. ..... F41A 17/066 42/70.06

* cited by examiner

*Primary Examiner* — Joshua Freeman
(74) *Attorney, Agent, or Firm* — Hauptman Ham, LLP

(57) ABSTRACT

A firearm safety device for preventing an individual from inserting a magazine or cylinder containing cartridges into the firearm, injecting a cartridge into the firing chamber and pressing the trigger contemplates a transmitter receiver with storage and record information in or on the firearm. The safety device also includes an electromechanical trigger lock, electromechanical magazine or cylinder lock for preventing a magazine or cylinder from being inserted into the firearm and an electromechanical lock for preventing a cartridge from being injected into the firing chamber. In addition, the safety device includes a second or remote transmitter/receiver for carrying by an individual user and/or owner of the firearm for activating and deactivating the firearm safety device. In this embodiment of the invention the safety device is activated if the firearm is pointed in the direction of the user/owner.

8 Claims, 4 Drawing Sheets

FIREARM SAFETY DEVICE

FIELD OF THE INVENTION

This invention relates to a firearm safety device and more particularly to a firearm safety device for preventing an individual from inserting a magazine or cylinder into the firearm, injecting a cartridge into the firing chamber of the firearm and locking the trigger mechanism.

BACKGROUND OF THE INVENTION

Safety devices for preventing a firearm from being fired are well known and have been in use for many years. More recent devices incorporate "smart gun" technologies to automatically control the discharge of a firearm as for example a biometric control such as a fingerprint sensor to restrict the discharge of a firearm only to one or perhaps more authorized persons having a fingerprint pattern stored in or on the firearm.

Transmitter/receivers have also been used to restrict or enable the discharge of a firearm. For example, a U.S. Patent of Mossberg et al. U.S. Pat. No. 5,564,211 discloses a Normally Enabled Firearm Control System That Is Directionally Disabled. As disclosed, a police officer or the like wears a transmitter that transmits signal energy in all directions. The transmitter may be worn by the authorized user on the user's person. The transmitter transmits a "disable" system that is received by a corresponding signal receiver built into the firearm only when the muzzle of the firearm is pointed in the direction of the authorized user. In other words, the receiver has a narrow angular spatial range of signal reception. In this way, if the firearm is taken away from the authorizer user, or the authorized user accidentally points the firearm at his/her person, then the firearm will be disabled automatically from firing by reception of the "disable" signal sent by the transmitter worn by the authorized user.

A more recent U.S. Pat. No. 6,711,844 of Rumfelt is directed to a Firearm Locking System And Method For Preventing Rotation Of A Cylinder. As disclosed, the firearm locking system and method of the invention provides a cylinder locking unit for a firearm adaptable to a firearm chamber, the cylinder locking unit including a receiver, an electric actuator, and a locking device extendible from the firearm chamber for preventing discharge of the firearm, the locking device extending upon activation of the electric actuator.

Further, a U.S. Pat. No. 8,464,459 of Summers discloses a Weapon Control Device that is coupled with a weapon and includes a processor and a connector operably engaging a selector switch in or on a weapon. The processor receives a signal from the connector in response to movement of the selector switch. The weapon control device further includes a transmitter and a transceiver, wherein one of the transmitter and transceiver send a signal in response to the processor receiving a signal from the connector. The weapon control device further includes a weapon accessory, wherein the weapon accessory is activated in response to the signal sent by one of the transmitter and transceiver Notwithstanding the above, it is presently believed that there is a need and a potential commercial market for an improved firearm safety device in accordance with the present invention. There should be a relatively large potential market since the system in accordance with the present invention because it includes a more fully safety system that totally disables the firearm.

SUMMARY OF THE INVENTION

In essence, the present invention comprises or consists of a firearm safety device for preventing an individual from inserting a magazine or cylinder containing cartridges into the firearm, injecting a cartridge into the firing chamber and pressing the trigger. The device comprises and/or consists of the following elements.

A control unit including a transmitter/receiver with storage and record information in or on the firearm, an antenna, and user interface in or on the firearm. In a preferred embodiment of the invention the unit also includes positioning triangulations. Still further, a system according to one embodiment of the invention implements geo-fencing.

A safety device includes an electromechanical trigger lock, an electromechanical magazine or cylinder lock for preventing a magazine or cylinder from being inserted into the firearm and an electromechanical lock for preventing a cartridge from being injected into the firing chamber.

In addition to the above, the safety device includes a second or a remote transmitter/receiver for carrying by an individual user and/or owner of the firearm for activating and/or deactivating the firearm safety device.

In one preferred embodiment of the invention the device includes a mechanism that prevents loading the firearm, injecting a cartridge into the firing chamber and/or depressing the trigger simultaneously.

The invention will now be described in connection with the accompanying drawings wherein like parts are referred to by like reference numerals.

In essence, a firearm safety device for preventing an individual from loading the firearm, injecting a cartridge into a firing chamber and pulling the trigger comprises or consists of the following.

First control unit includes a transmitter receiver with storage and record information that is disposed in or on the firearm, and wherein the safety device includes an electromechanical trigger lock that prevents the discharge of the weapon.

The safety device further includes a mechanism for locking or preventing the trigger from being pulled or from releasing a firing pin.

In addition, an electromechanical magazine or cylinder lock prevents a magazine or cylinder from being inserted into the firearm and prevents a cartridge from being injected into a firing chamber of the firearm. In addition, a second or remote transmitter receiver for carrying by an individual user for activating and/or deactivating the firearm safety device is included and wherein the second or remote transmitter receiver includes an indication of whether the firearm is completely disabled or totally enabled.

In a preferred embodiment of the invention, the safety device also includes a location sensor and a safety lock that prevents the firearm from being discharged when the firearm is pointed outside of a preselected area. This feature is most applicable for guns that remain at a gun club or range where guns are stored for use on the premises.

DESCRIPTION OF THE PREFERRED EMBODIMENTS OF THE INVENTION

Figure 1:
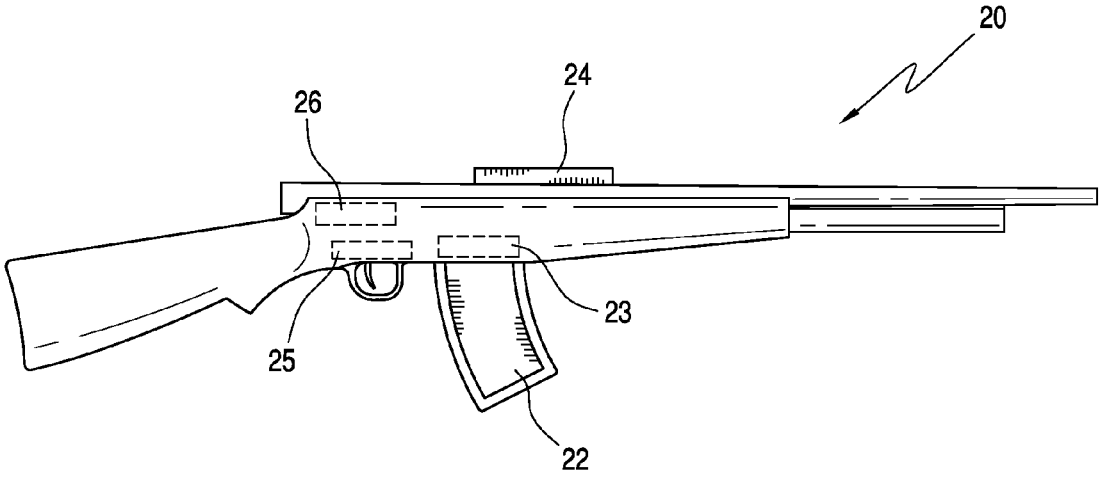
FIG. 1 is a schematic illustration of a rifle that incorporates a firearm safety device in accordance with a first embodiment of the invention.

As illustrated in FIG. 1, a firearm 20 or rifle includes a magazine 22 that contains a plurality of cartridges for loading the plurality of cartridges into the firearm 20. As indicated in FIG. 1, the firearm 20 includes an electromechanical locking mechanism 23 that prevents seating of the magazine for fully insertion of the magazine 22 into the firearm 20. The electromechanical locking mechanism 23 may include a solenoid operated rod or pin that prevents the magazine from entering into a seated position.

The electromechanical locking mechanism is activated by a control unit 24 that includes a multitude of sensors for location, direction, orientation, motion, time and a firearm microcontroller with memory for control, storage, record of information as well as an electromechanical trigger lock 25, the electromechanical loading lock 23 that prevents a magazine, cylinder or the like being inserted into the firearm and an electromechanical chambering lock 26 for preventing a cartridge from being inserted into a firing chamber of the firearm 20.

The details of a first or onboard control unit 24 and the electromechanical locking mechanism for locking a trigger, loading cartridges and for preventing a cartridge from entry into a firing chamber will vary according to the make and model of the firearm but are well within the skill of a person of ordinary skill in the art. However, an example of an electronic safety system for enabling/disabling a trigger lock follows.

Figure 2:
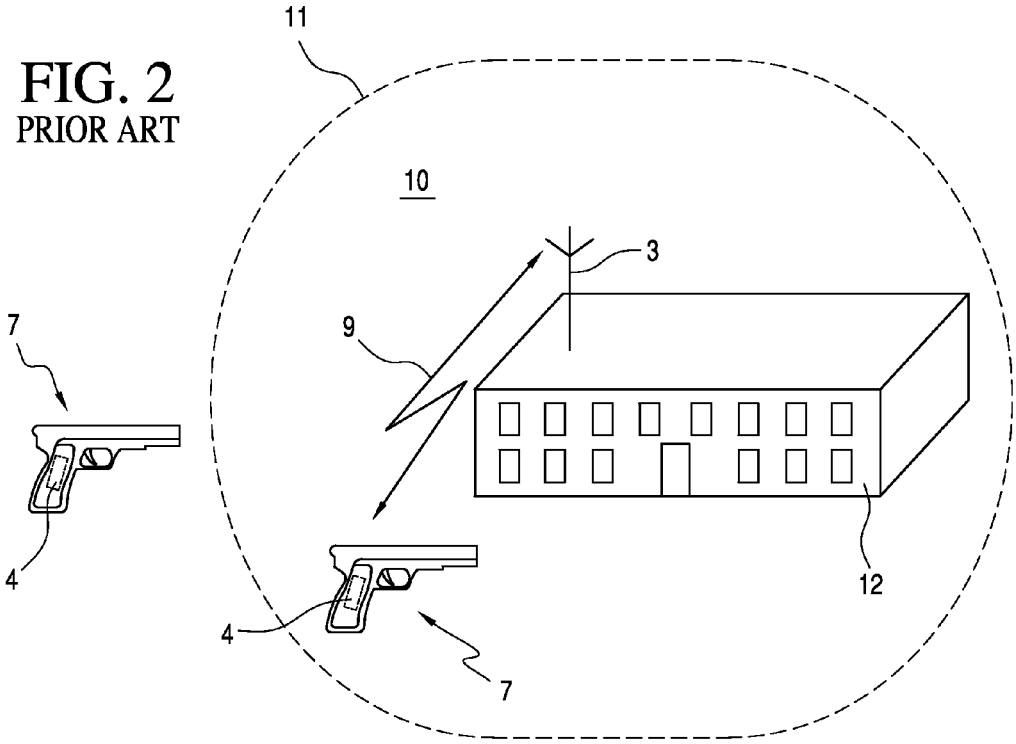
FIG. 2 PRIOR ART
FIG. 2 is a schematic illustration of a prior art safety system for enabling/disabling a firearm.
Figure 3:
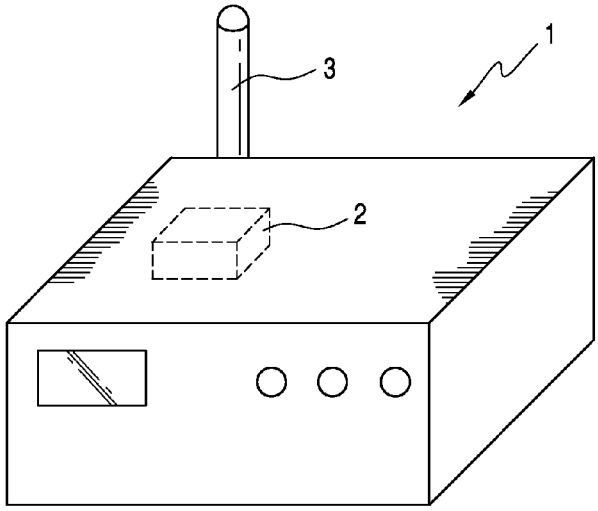
FIG. 3 PRIOR ART
FIG. 3 is a perspective schematic view of a base unit of the prior art safety system of FIG. 2.
Figure 4:
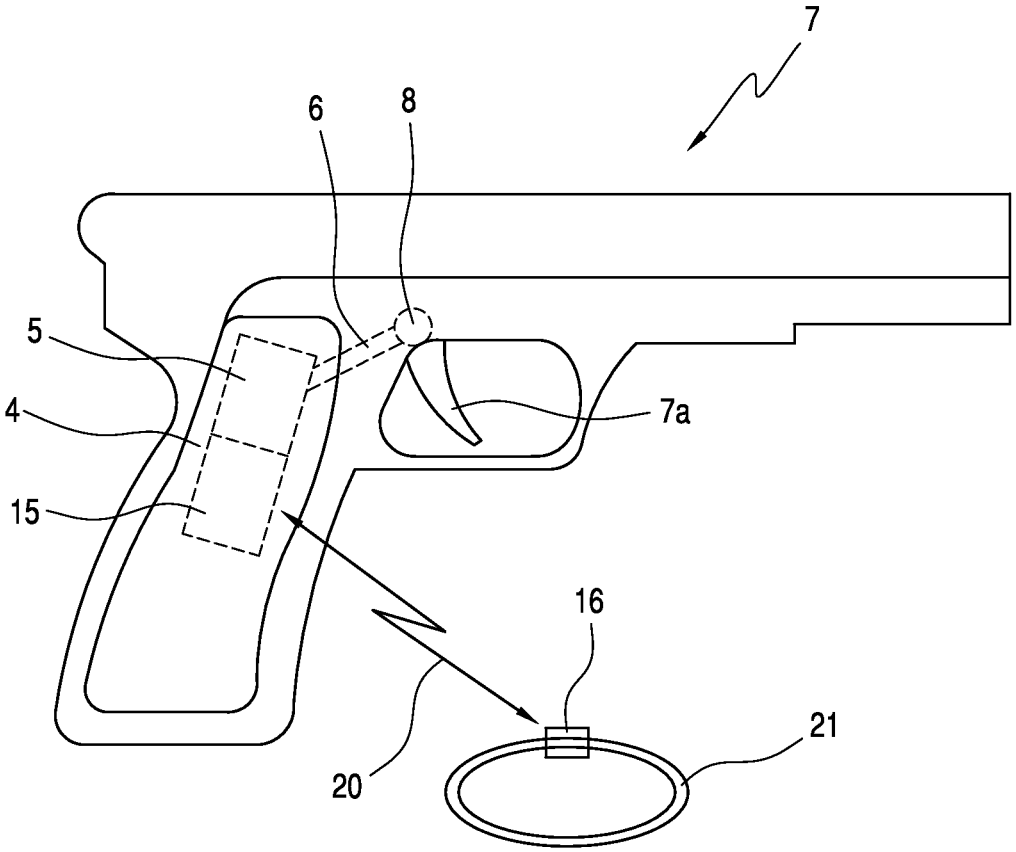
FIG. 4 PRIOR ART
FIG. 4 is a schematic view of a prior art firearm equipped with a safety device.

A prior art safety system for firearms is disclosed in a U.S. Patent of O'Shaughnessy et al. U.S. Pat. No. 8,127,482 which is incorporated herein in its entirety by reference and described in connection with FIGS. 2, 3 and 4 hereof. As illustrated, an enabling/disabling electronic system includes a base unit 1 comprising a transmitter/receiver 2 and an antenna 3. The base unit 1 co-operates with a safety device generally indicated by reference numeral 4 in FIG. 4. The safety device 4 is shown built-into a firearm 7 and includes a transmitter and/or receiver 5 adapted to exchange and process wireless command signals 9 with the transmitter and/or receiver 2 of the base unit 1. The safety device 4 further includes an actuating circuit 6 controlled by the transmitter and/or receiver 5 of the safety device 4. The actuating circuit 6 is adapted to actuate a locking mechanism 8 which is adapted to lock and unlock the trigger 7*a* of the firearm 7 in order to, respectively, disable or enable the firearm 7.

The wireless command signal 9 is operable within a predetermined distance between the base unit 1 and the safety device 4. Accordingly, when the firearm 7 equipped with the safety device 4 is located within a predetermined distance from the base unit 1, the transmitter and/or receiver (2, 5) of the base unit 1 and of the safety device 4 exchange the wireless command signal 9 which causes the transmitter and/or receiver 5 of the safety device 4 to prompt the actuating circuit 6 to actuate the locking mechanism 8 and cause the locking mechanism 8 to assume a locking mode in which the trigger 7*a* is locked and the firearm 7 is prevented from firing.

Safety device 4 can also store wireless command signals in its memory unit for cross reference, position/location and/or direction based activation/deactivation or prevention to command the safety device 4 to prompt the actuating circuit 6 to actuate the locking mechanism 8 to assume the locking mode in which the trigger 7 is locked and firearm is prevented from firing through actuating locking mechanism 23, 25 and 27 simultaneously.

The safety device 4 will have sensors including GPS sensor that will determine position of the device/firearm outdoors. The safety device control will determine position indoors with reference to the base unit and its beacons using radio signals emitted from beacons, time stamp and IMU sensors (inertial measurement unit). While another combination of sensors commonly called IMU or inertial measurement unit, which will include gyroscope, compass and accelerator will determine the direction of the safety device and firearm.

The system of the prior art prevents the use or misuse of a firearm 7 equipped with the safety device 4 within a designated area 10 (schematically defined by a dotted line 11 in FIG. 2) in which the use of firearms is prohibited, e.g. police station premises, school premises etc. To enable this, the base unit 1 is disposed within the designated area 10, e.g. inside a building 12. As soon as a firearm 7 equipped with the safety device is brought into the designated area 10, the transmitter and/or receiver (2, 5) of the base unit 1 and of the safety device 4 exchange the wireless command signal 9 and the locking mechanism 8 is actuated thereby locking the firing mechanism of the firearm 7. Conversely, as soon as the firearm 7 is taken outside the designated area 10, that is, outside the predetermined distance range, the base unit 1 and the safety device 4 stop exchanging and processing the command signal 9 and the actuating circuit 6 is prompted by the transmitter and/or receiver of the safety device 4 to unlock the locking mechanism 8.

The predetermined distance range between the base unit 1 and the safety device 4 within which the command signal 9 is operable and within which the transmitter and/or receiver 2 of the base unit 1 and the transmitter and/or receiver 5 of the safety device 4 can exchange and process the command signal 9 is sufficient to cover the designated area 10 in which firearms 7 equipped with the safety device 4 of the system of the invention need to be disabled. The predetermined distance range is preferably between 0 m and 100 m or between 0 m and 200 m.

Figure 5:
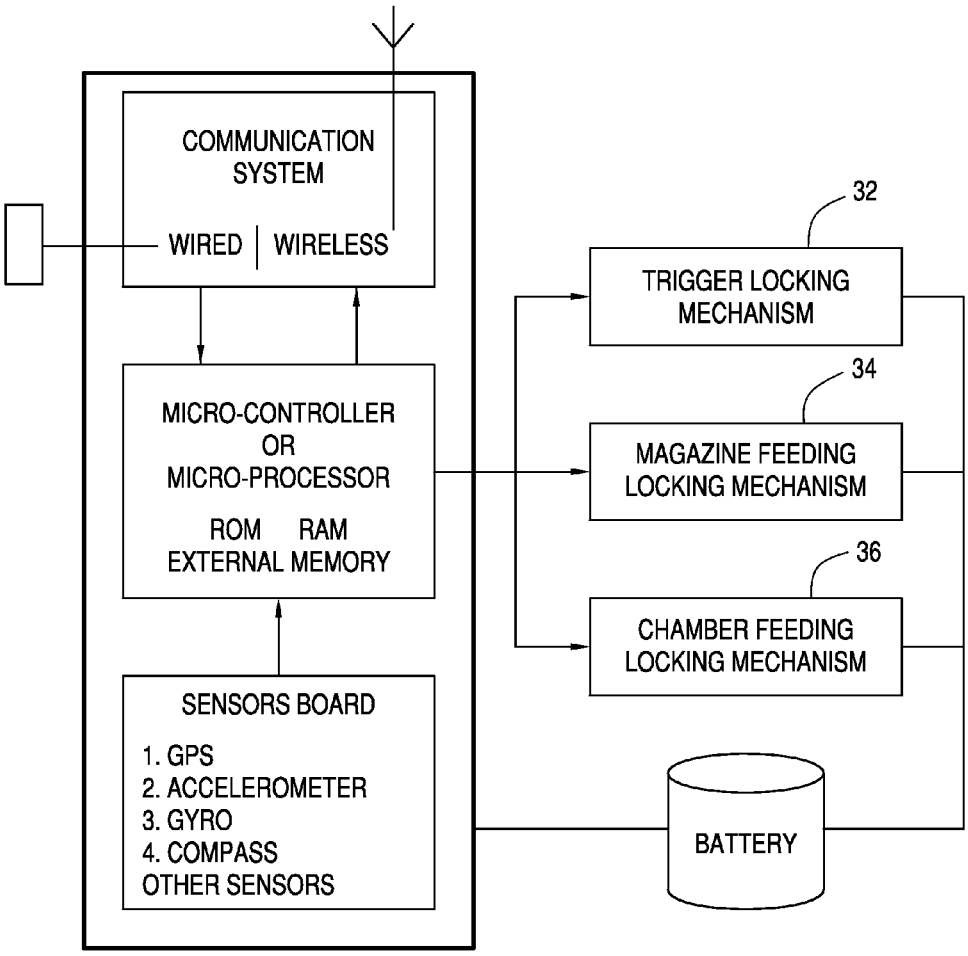
FIG. 5 is a diagram illustrating the components of a safety device in accordance with the present invention.

As illustrated in FIG. 5, the firearm prevention device includes the following components plus three independent locking mechanisms namely a trigger locking mechanism 32, a magazine locking mechanism 34 and a chamber feeding mechanism 36. The operation of the device is powered by a battery 40 inclusive of a solar recharging unit or rechargeable batteries. The device further includes a communications system wired and/or wireless plus a microcontroller or microprocessor inclusive of RAM and external memory. In addition, sensors are provided such as a GPS, accelerometer, gyro, compass and other sensors for sensing the presence and position of the user/owner and a sensor for restricting the firearm to be loaded, chambered and triggered unless the firearm is pointed down range in a restricted area.

A firearm safety device in accordance with a preferred embodiment of the present invention also includes a fail-safe system wherein all three electromechanical locking mechanisms are activated when the firearm is inactive for 60 or 90 minutes and until re-enabled by a remote control unit. In addition, all three of the electromechanical locking mechanisms disable the firearm at any time that the firearm is pointed in the general direction of the user/owner as long as they are carrying or wearing the remote control unit or other radio frequency control.

Figure 6:
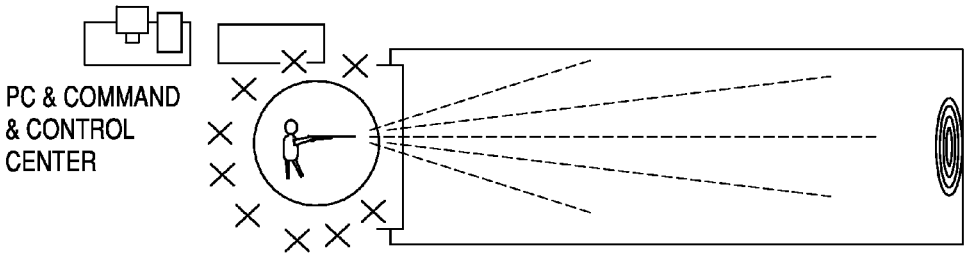
FIG. 6 is a schematic illustration of a firearm directional discharge preventive system wherein the invention functions to prevent firearm loading, firearm chambering and discharging of the firearm.

Finally, the preferred embodiment of the invention may also include a safety device and as illustrated in FIG. 6 wherein the device will limit or prevent loading cartridges, injecting a cartridge into the firing chamber and pulling the trigger unless the firearm is pointed down range.

In a preferred embodiment of the invention, the safety device includes a GPS sensor to determine the position of the device and firearm when outdoors as well as an IPS system for determining the indoor position by detection of its beacons using radio signals emitted from its beacon, time stamp and inertial measurement units (IMUs).

The following is a brief description of various components that may be used in providing the position and direction of a firearm. Such components are used in their customary manner and their combination and use is well within the manner known to a person of ordinary skill in the art.

Linear Solenoid Actuator:

Linear solenoid's basically consist of an electrical coil wound around a cylindrical tube with a ferro-magnetic actuator or "plunger" that is free to move or slide "IN" and "OUT" of the coils body. Solenoids can be used to electrically open doors and latches, open or close valves, move and operate robotic limbs and mechanisms, and even actuate electrical switches just by energizing its coil.

Linear Solenoid Construction:

This type of solenoid is generally called a Linear Solenoid due to the linear directional movement and action of the plunger. Linear solenoids are available in two basic configurations called a "Pull-type" as it pulls the connected load towards itself when energized, and the "Push-type" that act in the opposite direction pushing it away from itself when energized. Both push and pull types are generally constructed the same with the difference being in the location of the return spring and design of the plunger.

IMU:

An inertial measurement unit, or IMU, is an electronic device that measures and reports on a craft's velocity, orientation, and gravitational forces, using a combination of accelerometers and gyroscopes, sometimes also magnetometers. IMUs are typically used to maneuver aircraft, including unmanned aerial vehicles (UAVs), among many others, and spacecraft, including satellites and landers. Recent developments allow for the production of IMU-enabled GPS devices. An IMU allows a GPS receiver to work when GPS-signals are unavailable, such as in tunnels, inside buildings, or when electronic interference is present. A wireless IMU is known as a WIMU.

The IMU is the main component of inertial navigation systems used in aircraft, spacecraft, watercraft, and guided missiles among others. In this capacity, the data collected from the IMU's sensors allows a computer to track a craft's position, using a method known as dead reckoning.

Accelerometers, gyroscopes and IMUs are incredibly useful sensors which are being integrated more and more into the electronics devices. These sensors are used in cell phones, gaming consoles, toys, self-balancing robots, motion capture suits and more. Accelerometers are used mainly to measure acceleration and tilt, gyroscopes are used to measure angular velocity and orientation and IMUs (which combine both accelerometers and gyroscopes) are used to give a complete understanding of a device's acceleration, speed, position, orientation and more.

Gyrocompass:

A gyrocompass is a type of non-magnetic compass which is based on a fast-spinning disc and rotation of the Earth (or another planetary body if used elsewhere in the universe) to automatically find geographical direction. Although one important component of a gyrocompass is a gyroscope, these are not the same devices; a gyrocompass is built to use the effect of gyroscopic precession, which is a distinctive aspect of the general gyroscopic effect. Gyrocompasses are widely used for navigation on ships, because they have two significant advantages over magnetic compasses. They find true north as determined by Earth's rotation, which is different from, and navigationally more useful than, magnetic north, and they are unaffected by ferromagnetic materials, such as ship's steel hull, which change the magnetic field.

GPS:

The GPS system concept is based on time. The satellites carry atomic clocks which are synchronized, and their locations are known precisely. User receivers have clocks as well, but they are not synchronized with the satellites. They are less stable and only capable of measuring differences in time between signals received from satellites. GPS satellites transmit data continuously which contains their current time and position. A GPS receiver listens to multiple satellites and solves equations to determine the exact position of the receiver and the exact time of day. At a minimum, four satellites must be in view of the receiver in order to compute four unknown quantities (three position coordinates and time).

IPS:

Due to the signal attenuation caused by construction materials, the satellite based Global Positioning System (GPS) loses significant power indoors affecting the required coverage for receivers by at least four satellites. In addition, the multiple reflections at surfaces cause multi-path propagation serving for uncontrollable errors. These very same effects are degrading all known solutions for indoor locating which uses electromagnetic waves from indoor transmitters to indoor receivers. A bundle of physical and mathematical methods are applied to compensate for these problems. Promising direction radiofrequency positioning error correction opened by the use of alternative sources of navigational information, such as Inertial Measurement Unit (IMU), monocular camera Simultaneous Localization and Mapping (SLAM) and WiFi SLAM. Integration of data from various navigation systems with different physical principles can increase the accuracy and robustness of an overall solution.

While the invention has been defined in accordance with its preferred embodiments, it should be recognized that changes and modifications may be made therein without departing from the scope of the appended claims.

What is claimed is:

1. A firearm safety device for preventing an individual from loading the firearm, injecting a cartridge into a firing chamber and pulling the trigger, said device comprising:

a first control unit including a transmitter/receiver with storage and record information in or on said firearm; and wherein said safety device includes an electromechanical trigger lock, an electromechanical magazine or cylinder lock configured for preventing a magazine or cylinder from being inserted into said firearm and an electromechanical lock configured for preventing a cartridge from being injected into a firing chamber of said firearm; and a second or remote transmitter/receiver for carrying by an individual user for activating and/or deactivating said firearm safety device and wherein said second or remote transmitter/receiver includes an indication of whether the firearm is completely disabled or totally enabled.

2. The firearm safety device for preventing an individual from loading the firearm, injecting a cartridge into a firing chamber and pulling the trigger according to claim 1, in which said safety device prevents loading the firearm, injecting a cartridge in the firing chamber and pulling the trigger simultaneously.

3. The firearm safety device for preventing an individual from loading the firearm, injecting a cartridge into a firing chamber and pulling the trigger according to claim 2, that includes a fail-safe system that automatically locks the trigger, insertion of a magazine or cylinder into the firearm and injection of a cartridge into the firing chamber after a preselected time period of inactivity.

4. The firearm safety device for preventing an individual from loading the firearm, injecting a cartridge into a firing chamber and pulling the trigger according to claim 1, in which said electromechanical trigger lock, said electromechanical magazine or cylinder lock and said electromechanical insertion lock are individually activated or deactivated.

5. The firearm safety device for preventing an individual from loading the firearm, injecting a cartridge into a firing chamber and pulling the trigger according to claim 1, which includes remote means for sensing use by the user of the firearm to automatically lock the electromechanical trigger lock, electromechanical magazine or cylinder lock and the electromechanical insertion of a cartridge into the firing chamber lock whenever the firearm is pointed in the direction of the user/owner.

6. The firearm safety device for preventing an individual from loading the firearm, injecting a cartridge into a firing chamber and pulling the trigger according to claim 1, in which said safety device includes a location sensor and a lock for said trigger when said firearm is pointed outside of a preselected area.

7. The firearm safety device for preventing an individual from loading the firearm, injecting a cartridge into a firing chamber and pulling the trigger according to claim 6, which includes a timer and means for totally disabling the firearm after a 1½ hour period of inactivity with the firearm.

8. A firearm safety device for preventing an individual from loading the firearm, injecting a cartridge into a firing chamber and pulling the trigger, said device consisting of:

a first control unit including a transmitter/receiver with storage and record information in or on said firearm in which; and wherein said safety device includes an electromechanical trigger lock, an electromechanical magazine or cylinder lock configured for preventing a magazine or cylinder from being inserted into said firearm and an electromechanical lock configured for preventing a cartridge from being injected into a firing chamber of said firearm;

in which said safety device includes a location sensor and a lock for said trigger when said firearm is pointed outside of a preselected area; and a second or remote transmitter/receiver for carrying by an individual user for activating and/or deactivating said firearm safety device and wherein said second or remote transmitter/receiver includes an indication of whether the firearm is completely disabled or total enabled.

* * * * *